US005486008A

United States Patent [19]

Coburn

[11] Patent Number: 5,486,008

[45] Date of Patent: Jan. 23, 1996

[54] BULLET TRAP

[75] Inventor: Ronald Coburn, Westfield, Mass.

[73] Assignee: Passive Bullet Traps Limited, Douglas, Isle of Man

[21] Appl. No.: 154,023

[22] Filed: Nov. 17, 1993

[51] Int. Cl.[6] ..... F41J 1/12

[52] U.S. Cl. ..... 273/410; 273/404

[58] Field of Search ..... 273/394, 410, 273/404; 89/36.02

[56] References Cited

U.S. PATENT DOCUMENTS

| | | | |
|---|---|---|---|
| 385,546 | 7/1888 | Decumbus | 273/404 |
| 694,581 | 3/1902 | Reichlin | 273/404 |
| 840,610 | 1/1907 | Easdale | 273/404 |
| 2,013,133 | 9/1935 | Caswell | 273/410 |
| 2,772,092 | 11/1956 | Nikoden | 273/102.4 |
| 3,737,165 | 6/1973 | Pencyla | 273/102.4 |
| 4,126,311 | 11/1978 | Wagoner | 273/102.4 |
| 4,512,585 | 4/1985 | Baravaglio | 273/410 |
| 4,821,620 | 4/1989 | Cartee et al. | 89/36.02 |
| 5,070,763 | 12/1991 | Coburn | 89/36.02 |
| 5,113,700 | 5/1992 | Coburn | 89/36.02 |
| 5,121,671 | 6/1992 | Coburn | 89/36.02 |

FOREIGN PATENT DOCUMENTS 6353 of 1908 United Kingdom ..... 273/410

OTHER PUBLICATIONS

"Range Design Considerations" by Detroit Armor Corporation, 1986, pp. 1–38.

Miscellaneous Bullet Trap Product Information Sheet by Caswell International Corp.

*Primary Examiner*—Vincent Millin
*Attorney, Agent, or Firm*—Norbert P. Holler

[57] ABSTRACT

A bullet trap with a passageway defined between flat upper and lower boundary walls extending convergingly, at opposite angles of inclination of between 0° and about 15° to the horizontal, from an entrance opening to an exit opening or throat, and a deceleration chamber having a generally spirally curved circumferential boundary wall and provided in its upper region with an inlet opening and in its lower region with a discharge opening leading to a collecting vessel. The circumferential boundary wall of the chamber is constituted by two oppositely concave channel-shaped members the respective upper end regions of which are spaced from each other to define the inlet opening, and the respective lower end regions of which are spaced from each other to define the discharge opening. The chamber communicates at its upper region with the passageway substantially tangentially of the chamber via the directly adjacent inlet opening and throat, and a liquid lubricating fluid can be directed into the chamber from the collecting vessel either in a forced flow mode (pump-activated) through the inlet opening or in a passive mode (bullet-activated) through the discharge opening. For the special purpose of enabling a previously fired firearm to be checked for whether a bullet remains in the firing chamber of the firearm, the trap may have the same basic construction but without the liquid lubricating fluid feature.

23 Claims, 4 Drawing Sheets

W-2
W-1
FR
P-1
P-2
P-3
P-4
BT-1
BT-2
BT-3
BT-4
BT-5
T-1
T-2
C-1
C-2
C-3
C-4
C-5
10
11
13
13a
13b
13c
13d
14
15
15a
15b
16
17
18
18a
18b
18c
19
20
21
21a
22
23
23a
23b
24
24a
24b
27
27a
28
29
29a
30
30a
30b
31
33
35
35a
35b
37
38
39
40
S
X
X-1
B
α
β
3
4

56
45a
55
61
44a
42
58
54
43b
45c
45
45b
53
43
57
44
41
43a
44b
42a
47
46
49
52
60
59
50
48
51

81
83
83a
82
84
83b
80
85
86
84a

BULLET TRAP

This invention relates to bullet traps, i.e., devices used to catch and stop bullets fired from rifles, shotguns, handguns, and the like in a firearm manufacturing, repairing or testing facility or on a commercial, military/law enforcement or private/recreational firing range.

BACKGROUND OF THE INVENTION

Bullet traps per se are well known devices which have been used for many years by firearm manufacturers and users (the latter including firing ranges operated by military installations, police departments, rifle and pistol clubs, and the like) who are faced either with the need to proof, function fire and target firearms such as handguns, rifles and shotguns or with the task of simply collecting spent bullets fired on the range. In this context, "proof" means test firing a firearm at a higher load of ammunition, usually 40% greater, than the regular load specified for the barrel of that firearm; "function fire" means test firing the firearm through its full cycle of functions; and "target" means test firing the firearm for accuracy. The objectives of such devices have been to provide means located at a relatively short distance from the shooter to catch the lead or other types of bullets (jacketed or unjacketed) and prevent either the ricochet of a whole bullet or a large fragment thereof or the backsplattering of numerous small metal particles, which could return with enough energy to cause injury to the shooter or innocent bystanders, and to collect the waste lead, brass and jacket material. The known types of bullets traps have run the gamut from wood boards to sand-filled boxes to metallic funnel and deceleration chamber combinations, and their structural and functional characteristics as well as their drawbacks and disadvantages are set forth in U.S. Pat. Nos. 5,070,763, 5,113,700 and 5,121,671, to which reference may be had for the relevant details.

The type of bullet trap according to the invention disclosed in U.S. Pat. Nos. 5,070,763, 5,113,700 and 5,121,671 is designed to overcome those drawbacks and disadvantages and to be used with all types of manual firearms (including handguns, rifles, shotguns, elephant guns, and the like) and with all types of ammunition (ranging from airgun pellets up to and including armor-piercing bullets). To this end, the trap (like many of the known "funnel and chamber" types of traps) has a first pair of spaced, flat, preferably metal plates located, respectively, above and below the path of flight of a bullet being fired into the trap and a second pair of spaced, flat, preferably metal plates arranged transverse (usually vertically) to the first plates on opposite sides of the bullet flight path, with the two pairs of plates defining, respectively, the upper and lower walls and the right and left side walls of a passageway having at its front end an entrance opening (where a target may be located) and at its rear end an exit opening or throat, through both of which openings the bullet can pass. The trap also includes a spent bullet deceleration and energy-dissipating chamber the circumferential, likewise preferably metal boundary wall of which is of generally spiral configuration having a horizontal axis and the opposite end walls of which are constituted by portions adjuncts of the respective second plates, with the passageway communicating with the chamber through the throat substantially tangentially of the chamber at the bottom region thereof.

In that trap, the plates defining the upper and lower walls of the passageway, in order to minimize bouncing of the bullet back and forth during its travel through the passageway, are oriented at respective relatively low angles of inclination to the horizontal ranging up to about 15° (as explained in those patents, the angle of inclination may actually be as low as 0°, although that is not preferred) and the radius of curvature of the chamber wall at the initial as well as at all subsequent parts thereof is such as to keep the maximum amount of the side of the bullet presented to the chamber wall during its travel along those parts of the latter. The significance of this arrangement is that the shock of the bullet is distributed more evenly along the chamber wall and over a larger surface area thereof, and especially so in the initial part of the chamber wall, by virtue of which any potentially destructive tumbling of the bullet because of its nose digging into the chamber wall is prevented.

Moreover, in almost all forms of the trap (except when it is designed solely for use in catching airgun-fired projectiles such as pellets or BB's and may be made of a self-lubricating plastic material), a spray nozzle arrangement is provided within the deceleration chamber substantially axially thereof for directing a liquid lubricating fluid, preferably a white water lubricant (consisting of, for example, 4 parts water and 1 part mineral oil), against the initial part of the interior surface of the circumferential boundary wall of the deceleration chamber. The liquid, after having lubricated the initial part of the said boundary wall surface of the chamber and any bullets circumnavigating the chamber (it will be understood, in this regard, that the rapidly moving bullets pick up and carry along some of the liquid lubricant when passing through it, which ensures that the lubricant will be effective to reduce friction between the bullets and even those regions of the surface of the circumferential boundary wall of the chamber which the spray may not have contacted directly), flows downwardly in the chamber toward the bottom thereof, ultimately flowing out of the chamber and into the passageway through the throat thereof and then along the lower first plate to a collecting vessel. The "wet" trap thus is designed not only to minimize the metal to metal contact between the bullets and the metal surfaces along which they move, with the result that scoring and erosion of those surfaces as well as the generation of lead dust, if the bullets are made of lead, are reduced as far as possible, but also to ensure that shells, casings, spent bullets, any lead dust that is generated, and even any fragments of a larger size that might split off from the bullets, are engulfed in the liquid and are flushed thereby along the lower first plate of the passageway and into the collecting vessel. Preferably, the spray nozzle system is interconnected with the collecting vessel by suitable piping and a pump so that the liquid lubricating fluid, after separation of solids therefrom in the collecting vessel, can be recirculated from the latter to the spray nozzle conduit.

The advantages of the bullet traps disclosed and claimed in the said in U.S. Pat. Nos. 5,070,763, 5,113,700 and 5,121,671 are manifold. Very significantly, the traps are relatively inexpensive to manufacture, can be constructed for transportability and ease of installation, and do not require the provision of thick walls, sand mounds or like back-up structures. Also, the traps are multi-functional and permit proofing, function firing and targeting of handguns, shotgun and rifles (including high powered rifles) in one system, so that expenses that might have to be incurred in connection with the known types of bullet traps for providing duplicate separate systems for function firing, targeting and proof testing can be avoided. Moreover, whereas for safety reasons high powered rifles conventionally are test-fired only at outdoor long-distance firing ranges, the use of an appropriate version of these traps permits test-firing of such rifles to be safely performed even in a relatively small room with a distance of only 75 feet (22.86 m) or less between the muzzle of the gun and the trap.

Thus, since the traps can withstand even such high energy ammunition as 30.06 NATO armor-piercing bullets, 600-grain elephant gun bullets, and the like, wear and tear on the traps, maintenance requirements therefor, and the need for periodic replacement of parts of the traps (in particular the plates defining the upper and lower walls of the passageway and the circumferential boundary wall of the deceleration chamber) and the attendant costs thereof are all greatly reduced if not eliminated altogether. Still further, when a bullet is fired into such a "wet" trap, any lead dust generated in the course of the movement of the bullet along the metal surfaces of the trap is inevitably, and without any possibility of escape from the system, engulfed by and entrapped in the liquid lubricant sprayed out of the spray nozzles and continuously flowing downwardly over the chamber wall and from there on over the lower wall of the passageway. As a consequence, the lead dust is flushed by the liquid into the collecting vessel, where it settles out of the liquid and accumulates on the bottom of the vessel and hence cannot be dispersed from the vessel into the surrounding atmosphere. The so-achieved salvaging of the otherwise normally wasted lead dust for reuse in making bullets provides (apart from the environmental and safety benefits) an economic benefit as well, which has not been achievable with any of the previously known bullet traps.

Occasionally, however, some users of the bullet traps of the mentioned three patents have encountered a problem under certain conditions. The problem resulted from the fact that larger bullets fired from center fire handguns tend to flatten out somewhat when hitting up against one or the other of the passageway ramps of the trap, and, because of their lower speed and energy, they do not break up when running around the interior of the deceleration chamber but rather stay intact. Thus, when such bullets come out of the chamber and onto the lower passageway ramp for their intended movement along the latter down to the collecting vessel, they tend actually to remain in place on the ramp despite the flow of the liquid lubricant down the ramp, in effect adhering or binding to the ramp at their flat surface portions. While this is of no real consequence in single shot firings, in cases of automatic or continuous firing, i.e., when many rounds are fired in a substantially continuous burst or sequence from an automatic or semiautomatic pistol, the earlier fired bullets which have come out of the chamber and to a stop on the ramp will form a dam on the ramp. Any later incoming bullets hitting the dam will then be blocked from entering the deceleration chamber and may have their desired slightly deflected flight paths undersirably and unpredictably altered. As a result, the trap fails to function properly, which may lead to the trap being damaged and/or destroyed and could possibly also result in injury and/or death of the shooter or innocent bystanders. (It should be noted, merely in passing, that the rapid firing of center fire rifles is not beset by this problem because their bullets, having greater speed and energy, tend to disintegrate in the chamber into much smaller pieces or fragments which will not stick to the ramp but will be flushed along and off the same by the liquid lubricant flowing from the chamber and down the ramp to the collecting vessel.)

The sticking problem could, of course, have been solved by a suitably large increase of the liquid pressure and the liquid flow velocity in the circulating and flushing system. That, however, would have created additional energy requirements for the system, namely, larger pumps, larger pipes and valves, greater electric power sources, etc., and would also have led to increased size, weight and cost of the traps.

BRIEF DESCRIPTION OF THE INVENTION

It is the primary objective of the present invention to provide novel and modified versions of the bullet traps disclosed in the aforesaid U.S. Pat. Nos. 5,070,763, 5,113,700 and 5,121,671.

It is another object of the invention to provide such novel and modified bullet traps which are best suited for use by persons and organizations such as sporting shooters, gunsmiths, range managers, and the like interested primarily in targeting firearms but not function firing and proofing, and which are designed for use primarily in a "wet" form (i.e., with a pumped or actively applied or a pumpless or passively applied liquid lubricant) in both indoor and outdoor ranges as well as in a variety of special applications.

A more specific object of the invention is to provide such novel and modified bullet traps in which the deceleration and energy-dissipating chamber of each trap communicates at its top with the associated passageway through the throat formed by the respective upper and lower plates or walls of the passageway and further has an exit or discharge opening for spent projectiles at its bottom, thereby to eliminate any possibility of return movement of such projectiles or of shells, casings, bullet fragments and lead dust along the lower passageway plate to the front of the trap, as well as any possibility of a "bullet dam" being built up on the lower passageway ramp.

Yet another object of the invention is to provide such a "wet" bullet trap in which the means for directing the liquid lubricating fluid into the deceleration chamber and against the interior wall surfaces of the latter may be arranged to introduce the liquid lubricant into the chamber either at the top thereof through the passageway throat or at the bottom through the discharge opening.

Generally speaking, in each trap according to the present invention the circumferential boundary wall of the deceleration and energy-dissipating chamber comprises two cross-sectionally arcuate channel-shaped members with horizontal axes of curvature and having their concavities facing each other so as to define therebetween the interior space of the chamber. That one of the channel-shaped members the concavity of which faces frontwardly, i.e., toward the location of the entrance opening of the trap, merges at the uppermost end of its arcuate section into a straight planar section which is preferably inclined upwardly relative to the horizontal at an angle of up to about 15° and extends past the uppermost end of the arcuate section of the second channel-shaped member the concavity of which faces rearwardly, i.e., away from the entrance opening of the trap. The said straight planar section of the first-mentioned channel-shaped member thus effectively constitutes the terminal part of, and may be of one piece with, the correspondingly inclined upper wall of the passageway, with the throat or exit opening of the passageway being defined between that terminal part of the upper wall and the juxtaposed terminal part of the oppositely inclined lower wall of the passageway which is secured to the uppermost end of the arcuate section of the second channel-shaped member. The latter at the lowermost end of its arcuate section merges into a straight planar section which is downwardly inclined relative to the horizontal at an angle of preferably between about 15° and about 30° in the direction away from the front of the trap and is of sufficient length to terminate at a spacing of between about 1 inch (2.54 cm) and about 3 inches (7.62 cm) from the lowermost end of the arcuate section of the first channel-shaped member, thereby to define a bottom discharge opening for enabling spent bullets to drop out of the deceleration chamber into a collecting vessel located therebelow or into a chute leading to such a vessel.

A bullet trap according to the present invention, as previously mentioned, preferably is of the "wet" type, i.e., it is provided with means for causing a liquid lubricant to be spread over the various surfaces, namely, the lower ramp or wall surface of the passageway and/or the inwardly directed faces of the channel-shaped members constituting the circumferential boundary wall surfaces of the deceleration chamber, which will be contacted by bullets fired into the trap. Such lubrication may be effected, depending on the nature of the trap, either with the aid of a pumped or forced flow system or by means of a pumpless, bullet-activated system.

In the pumped system, on the one hand, the liquid lubricant is initially contained in the collecting vessel which is located below the bottom discharge opening of the deceleration chamber and in line with a chute or funnel for guiding solids such as spent bullets, fragments, shells, casings and lead dust into the vessel. Although the dimensions of the collecting vessel and their relationships to the dimensions of the deceleration chamber and the bottom discharge opening thereof are not critical per se, it will be apparent that the width of the vessel, or at least the width of its top opening, must be somewhat greater than the width of the chute or funnel.

The liquid lubricant is positively fed from the vessel to the chamber by means of piping having incorporated therein a pump and a spray nozzle arrangement. The latter is constructed and arranged to direct liquid sprays against the frontwardly facing section of the inner boundary wall surface of the chamber over substantially the full length of the chamber and at least partly also onto the surface of the lower wall or ramp of the passageway leading to the chamber over the full width of the ramp. Thus, those surfaces are directly lubricated to reduce friction between them and the passing bullets. Moreover, since a bullet also picks up lubricant as it passes through the sprays and as it contacts and moves along the directly lubricated surfaces, the lubricant it carries ensures that frictional contact between such bullet and any portion of the chamber surface which is not directly lubricated is also reduced. By virtue of such lubrication, therefore, not only are the various contact surfaces of the trap protected against wear, but also the amount of lead dust that may be generated is reduced as much as possible, because the bullets fired into the trap effectively hydroplane over those surfaces. Liquid running over and down the chamber wall surfaces ultimately flows back into the collecting vessel through the discharge opening of the chamber, while liquid running down the lower passageway ramp is returned to the vessel via a sump and drain pipe combination arranged preferably at the lowest end region of the ramp but possibly also at an intermediate region thereof.

It is presently contemplated that pumped lubricating systems are best suited for use in connection with "wet" traps located indoors, for example, as parts of multiple trap indoor firing ranges, box traps (single shooting stations), gunsmith testing installations, and the like, where a relatively heavy liquid flow for flushing purposes is desired and electrical power from the building main for operating the pumps is readily accessible.

In the pumpless system, on the other hand, the collecting vessel, which in this case is coextensive in length with the axial length of the deceleration chamber, is typically somewhat wider than the chamber so that, because the system does not include a pumping arrangement, the deceleration chamber can have its lower region positioned within the confines of the collecting vessel and below the level of the quantity of liquid lubricant in the vessel. Thus, in this system the lowermost arcuate section of the first channel-shaped member and the adjacent downwardly inclined straight planar section of the second channel-shaped member (between which sections the discharge opening of the deceleration chamber is defined) are both submerged in the static body of liquid in the collecting vessel.

It will be understood, therefore, that when a bullet fired into a pumpless "wet" trap enters the deceleration chamber and races around the circumferential boundary wall of the latter (jumping over the entrance and exit openings as many times as its kinetic energy permits), it repeatedly and at an at least initially very high speed enters and passes through the portion of the body of liquid which is located within the confines of the lower region of the deceleration chamber. At each such entry into the body of liquid, the bullet not only splatters appreciable amounts of the liquid upwardly against the non-submerged middle regions of the chamber wall but also picks up and carries along a coating of the liquid which provides for a lubricated contact between the bullet and the upper regions of the chamber which may not have been reached by the splattered liquid. Any liquid splashed on the chamber wall will, of course, ultimately run down the same back into the part of the body liquid which overlies the discharge opening of the chamber. To guard against the possibility that some of the splattered liquid, if it were to reach the lower ramp of the passageway, might run down the latter and out the front end of the trap, provision may be made for ensuring a return of that liquid to the collecting vessel by means of a sump and drain pipe combination incorporated preferably in the mid-region and across the full width of the ramp. Alternatively, the splattered liquid may be essentially completely inhibited from reaching the lower passageway ramp by providing the latter with a full-width portion extending into the deceleration chamber from the juncture of that portion with the upwardly inclined body of the lower passageway ramp, with the said extension portion being disposed at a downward inclination substantially paralleling that of the straight planar section of the first channel-shaped member of the deceleration chamber.

It is presently contemplated that pumpless lubricating systems are best suited for use in connection with "wet" traps which are either located out of doors, for example, as parts of outdoor ranges, where electrical power is not readily accessible or is too expensive to install, or are designed for applications not requiring heavy liquid flows, for example, as parts of pistol and rim fire traps where only relatively low energy ammunition (.22 caliber rifle to .22 Magnum handgun) is to be used.

It is further contemplated by the present invention that for one special situation, concerned with the safety of both shooters and non-shooters after a firearm has been fired, a bullet trap of the type herein disclosed and having a deceleration chamber with a top entrance opening and a bottom discharge opening need not be "wet" but may actually be contructed as a "dry" trap, i.e., without any liquid lubricant system. It is a well-known fact that many persons (adults as well as children, and even persons who are experts in the use and care of firearms) are wounded or killed every year by guns being fired accidentally. Such a firing may occur, for example, if the trigger of a gun is pulled by a person who may be playing with the gun or handling it carelessly or actually pointing it at another person while believing that the gun "is not loaded." Similarly, guns are frequently discharged inadvertently upon being dropped on or knocked against a hard surface, with disastrous consequences to either the person handling the gun or to an innocent bystander, which is an accident that can happen without warning even to an expert in the handling of firearms whenever a bullet has been knowingly or unknowingly left in the firing chamber of the gun.

The risk of a bullet being inadvertently left in the chamber of a gun is, of course, greatest when the gun has just been fired, for example, by a person practicing target shooting at a firing range or by a gunsmith testing a gun after servicing or repairing it. To minimize this risk it is believed appropriate that each establishment where guns are fired should be equipped, either next to each firing station or at an exit location through which each shooter carrying a gun will have to pass, with a special bullet trap into which the shooter will be instructed and expected to point and "fire" his gun for the purpose of making certain that the gun is in fact not loaded. It is because this checking of the status of each firearm will as a general rule entail only a single pull of the trigger, the result of which will be either no firing at all in most instances if, as is hoped, the chamber is empty or the firing of only a single shot in some instances if, against all hope, the chamber was not empty, that the trap can be of a relatively simple and inexpensive construction and devoid of a liquid lubricant circulation and flushing system. The "dry" status-check trap thus can be relatively small in size compared to the "wet" traps; merely by way of example, such a "dry" trap may be as small as 22 inches (55.9 cm) in length, 5 inches (12.7 cm) in width, and 20 inches (50.8 cm) in height, whereas a "wet" trap designed for an indoor firing range may be as large as 216 inches (548.6 cm) in length, 96 inches (243.8 cm) in width, and 96 inches (243.8 cm) in height.

BRIEF DESCRIPTION OF THE DRAWINGS

The foregoing and other objects, characteristics and advantages of the present invention will be more clearly understood from the following detailed description thereof when read in conjunction with the accompanying drawings, in which.

DETAILED DESCRIPTION OF THE INVENTION

Figures 1, 2:
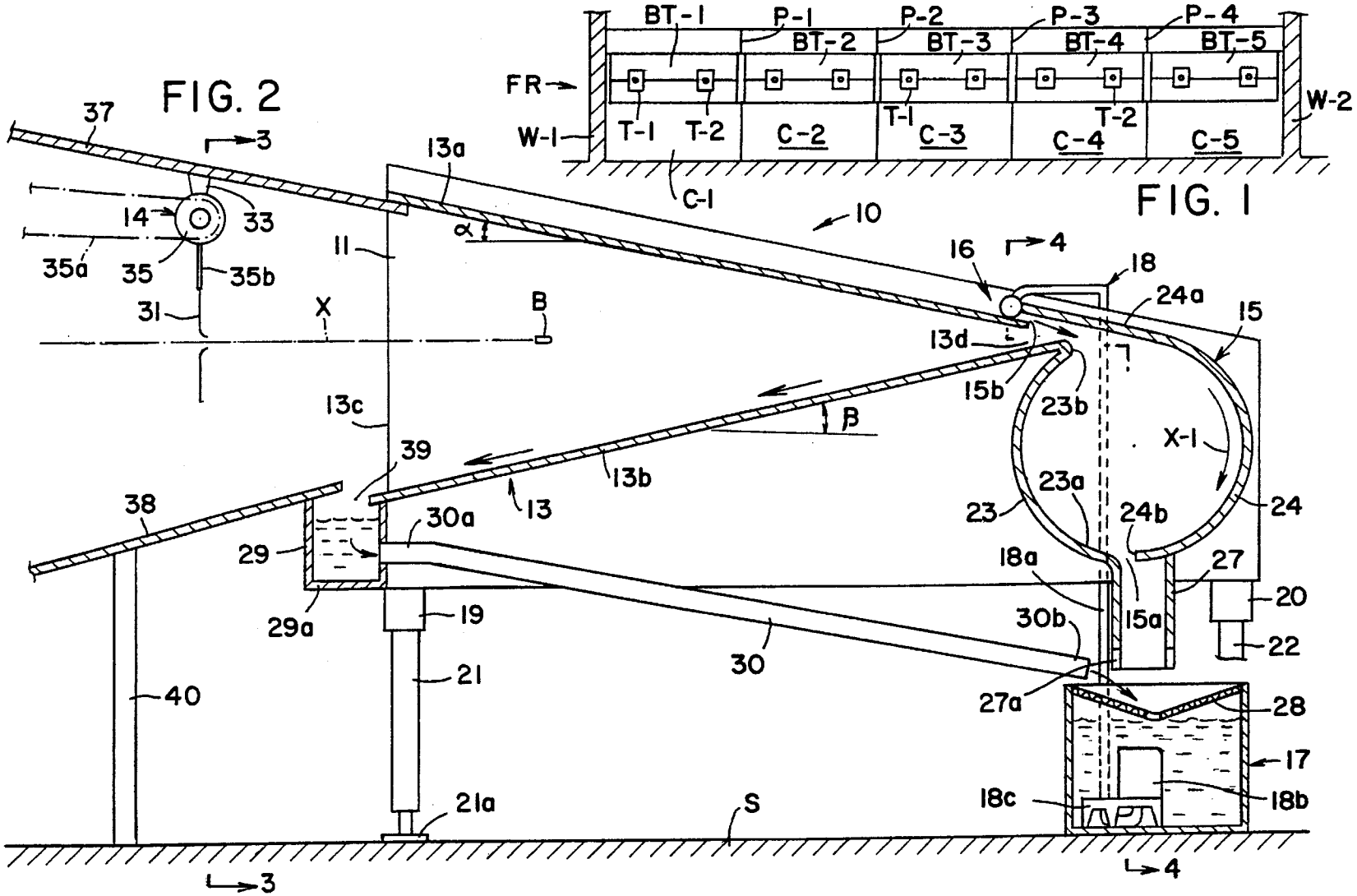
FIG. 1 is a schematic front elevational view of a typical firing range equipped with bullet traps behind the various targets.
FIG. 2 is a longitudinal vertical section through a pumped type of "wet" bullet trap according to one embodiment of the present invention, designed for use in an indoor firing range.

Referring now to the drawings, FIG. 1 shows, by way of example only, a 10-position indoor firing range FR arranged between end walls W-1 and W-2 (e.g., the side walls of a large room) and divided by partitions P-1 to P-4 into a set of five compartments C-1 to C-5. The compartments typically are 8 feet (243.8 cm) wide each, and arranged therein are respective bullet traps BT-1 to BT-5 according to the present invention, each extending across the entire width of its respective compartment. In front of each of the bullet traps there are provided two targets T-1 and T-2, which are mounted in any suitable manner to be more fully described presently and are arranged at a center-to-center spacing of 4 feet (121.9 cm). Associated with the firing range FR at a suitable distance from the targets are, of course, respective cubicles or standing areas (not shown) for the individual shooters.

It might be mentioned here, merely in passing, that the front edges of the partitions may on occasion be hit head-on by a misdirected bullet, for example, where the shooter is a novice, or where the firearm is inadvertently moved at the instant of firing (which can happen even to an expert shooter), or where the gunsight is improperly aligned, or the like. In such a case, the risk that the bullet may rebound toward the shooter or another person on the firing range and may injure one or another of them is substantial. To minimize this risk, the front edges of the partitions may be overlaid by a "splitter" (not shown) in the form of a cross-sectionally V-shaped hardened steel plate protector providing a frontwardly facing sharp knife edge (the included angle between the legs of the "V" may be as large 60° or so). A bullet hitting the protector edge head-on would thus be split, with the fragments flying off laterally but not back toward the shooter.

It will further be understood that the partitions P-1 to P-4 in the firing range FR could actually be omitted entirely, so as to have only a single full-width compartment defined between the side walls W-1 and W-2. In such a single compartment there may then be provided (as desired by the range operator) either a set of bullet traps BT-1 to BT-5 each behind a respective pair of targets T-1 and T-2 as described above, or a set of somewhat wider bullet traps each behind a respective larger plurality of targets, or a set of narrower bullet traps each behind a respective individual target, or a single full-width bullet trap behind the entire array of targets.

Figure 4:
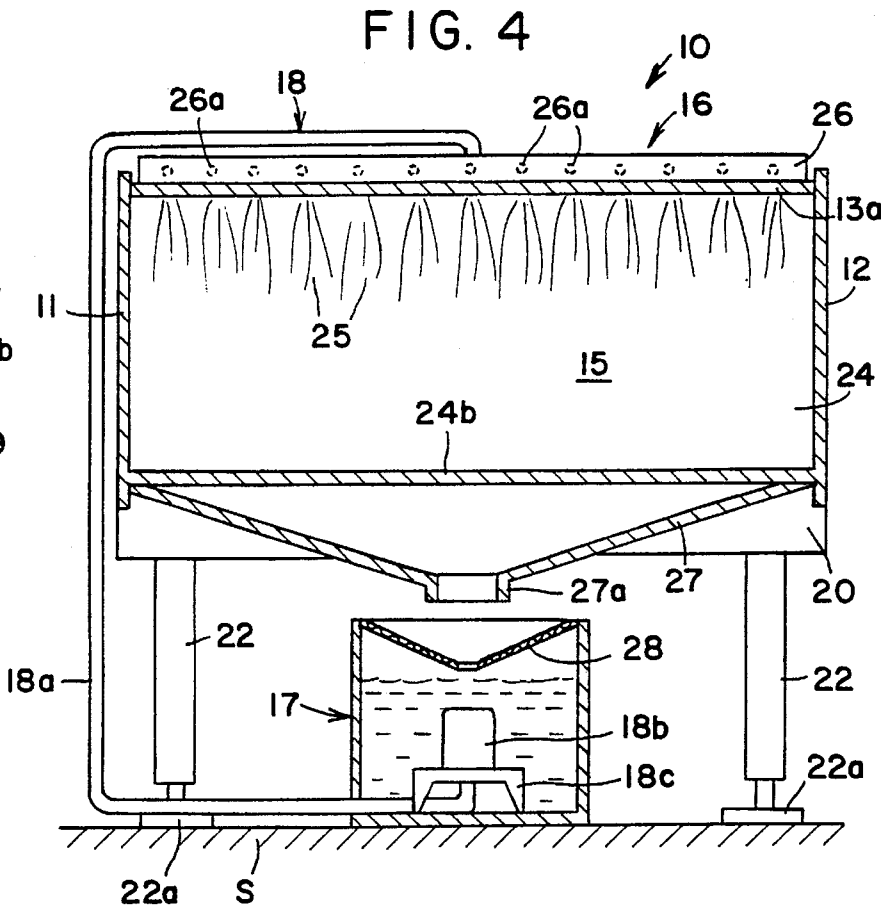
FIG. 4 is a sectional view taken along the line 4—4 in FIG. 2 and schematically illustrates the liquid lubricant spraying and circulating system.
Figure 3:
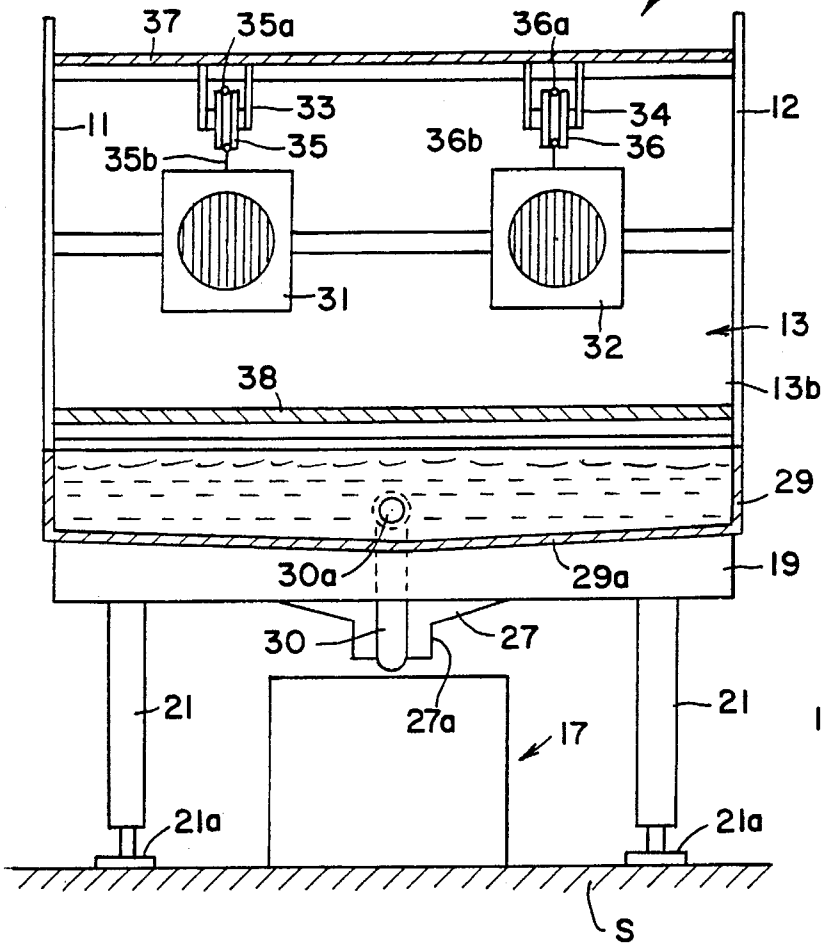
FIG. 3 is a front end elevational view of the trap shown in FIG. 2, with some parts being broken away and others being illustrated in section to show details, the view being taken along the line 3—3 in FIG. 2.

Each of the bullet traps BT-1 to BT-5 according to the present invention, a representative one of which is designated by the reference numeral 10 in FIGS. 2, 3 and 4, includes, between a pair of spaced elongated vertical side walls 11 and 12, a passageway structure 13 having upper and lower walls 13*a* and 13*b* and into the front end entrance opening 13*c* of which a projectile B, typically a powder-discharged bullet, can be fired from a firearm (not shown) supported either by the shooter in person or on a suitable test-firing stand (not shown). The trap further includes at its front end a target positioning means 14 and at its rear end a generally spirally configured spent projectile deceleration and energy-dissipating chamber 15 the interior of which communicates substantially tangentially thereof at its top region with the interior of the passageway structure 13 through a shallow exit opening or throat 13*d* of the latter. The chamber 15 is shown as being equipped with a suitable spray nozzle means 16 for spraying a liquid lubricant into the chamber, i.e., the trap 10 is a "wet" trap. A collecting vessel 17 for receiving liquid lubricant and solids discharged from the chamber 15 is arranged under a bottom discharge opening 15*a* of the chamber, and suitable conduit means 18, including a piping arrangement 18*a* and a pump 18*b*, is provided between the collecting vessel 17 and the spray nozzle means 16 for feeding liquid lubricant from the collecting vessel to the spray nozzle means.

The side walls 11 and 12 of the trap 10 are connected in any suitable manner at a plurality of longitudinally spaced locations (two are illustrated, although more can be used if needed) to the opposite ends of respective horizontal cross beams 19 and 20 which are connected to and supported by respective pairs of vertical legs 21 and 22 adapted to stand on a suitable supporting surface S, for example, the floor of a room or basement of a building, through the intermediary of adjustable leveling feet 21*a* and 22*a*. Additional rigidity may be imparted to the side wall structure of the trap by conventional stiffening plates and brackets (not shown).

The upper and lower walls 13*a* and 13*b* of the passageway structure 13 of the trap are connected at the respective opposite side edges thereof to the inwardly directed faces of the side walls 11 and 12. The plates 13*a* and 13*b* are located above and below, respectively, the horizontal path of flight X of the projectile B. In the illustrated embodiment of the invention, the plates 13*a* and 13*b* are shown as being oppositely inclined relative to the horizontal at respective angles $\alpha$ and $\beta$ and as converging toward one another from the front end region of the trap toward the rear end region thereof, i.e., in the direction of flight of the projectile. The plates 13*a* and 13*b* thereby define a generally funnel-shaped passageway structure having a relatively wide entrance opening 13*c* at the front end and a relatively shallow throat or exit opening 13*d* at its rear end. The angles of inclination $\alpha$ and $\beta$ of the plates 13*a* and 13*b*, depending on the nature of the trap as determined by the types of firearms and ammunition with which it is designed to be used, lie between 0° and about 15° to the horizontal and preferably (but not necessarily) are equal to each other.

The deceleration chamber 15 of the trap 10, which has a horizontal axis, is located generally rearwardly of the passageway structure 13 and is defined between respective portions of the side wall-forming plates 11 and 12 in the rear end region of the trap and a circumferential boundary wall structure connected at its opposite side edges to the plates 11 and 12. The boundary wall structure of the chamber 15 consists of two juxtaposed, oppositely arcuate, channel-shaped or half shell-like plate members 23 and 24, with the concavity of the member 23 facing rearwardly of the trap, i.e., in the direction away from the entrance opening 13*c*, and with the concavity of the member 24 facing frontwardly of the trap, i.e., in the direction toward the entrance opening 13*c*. The plate member 23 is continuously curved over most of its extent from its uppermost end region where its end edge adjoins and is welded to the rearwardmost end edge of the lower ramp 13*b* of the passageway structure 13, and at its lowermost end region has a straight planar section 23*a* which is about 3 to 6 inches (7.6 to 15.2 cm) wide over its entire length between the side walls 11 and 12 and is inclined downwardly relative to the horizontal at an angle of between about 15° and 30° . Correspondingly, the plate member 24 is continuously curved over most of its extent from its lowermost end region and at its uppermost end region has a straight planar section 24*a* which is about 6 to 8 inches (15.2 to 20.3 cm) wide over its entire length between the side walls 11 and 12 and is inclined upwardly relative to the horizontal at an angle substantially equal to the angle of inclination of the upper wall or ramp 13*a* of the passageway structure 13.

The arrangements thus are such that the straight planar section 23*a* of the member 23 is spaced from and extends to a level somewhat below the level of the juxtaposed lowermost edge 24*b* of the member 24, thereby defining the bottom discharge opening 15*a* of the chamber 15; that the straight planar section 24*a* of the member 24 is spaced from and extends to a level somewhat above both the edge 23*b* of the member 23 and the rearwardmost end edge of the upper wall or ramp 13*a* of the passageway structure 13, thereby defining not only the throat 13*d* through which the projectile B can enter the deceleration chamber 15 but also the slit shaped aperture 15*b* through which the liquid lubricant can be sprayed into the chamber by the spray nozzle means 16; and that the opposed concave surfaces of the two channel-shaped or shell-like members 23 and 24 together define a generally spirally curved boundary wall surface along which a projectile B will be guided so as to circumnavigate the chamber while being decelerated and dissipating its kinetic energy.

It should be noted at this point that, as in the case of the bullet traps disclosed in the aforesaid U.S. Pat. Nos. 5,070,763, 5,113,700 and 5,121,671, the radii of curvature of the various concave parts of the circumferential boundary wall of the deceleration chamber 15, depending on the nature of the trap and the types of firearms and ammunition with which it is designed to be used, have in each case been empirically determined as being appropriate for the circumferential wall surface of the respective deceleration chamber so as to enable the same to function as a deflection plate for relatively gently turning the projectile B out of its pre-contact straight ahead trajectory to a curving path actually reversing its initial direction of flight, as indicated by the arrow X-1 in FIG. 2. However, it will also be understood that higher power firearms and bullets will generally require larger radii of curvature and hence larger deceleration chambers than lower power firearms and bullets.

Within these parameters, therefore, the radii of curvature of the arcuate sections of the boundary wall members 23 and 24, which ordinarily but not necessarily will be equal to each other, may be small as about 5 inches (12.7 cm) and range up to as much as about 30 inches (76.2 cm). Merely by way of example, it has been determined that: in a trap designed for nothing more powerful than rim and pistol fire bullets it will be adequate for the minimum radius of curvature of the deceleration chamber boundary wall surfaces to be between about 5 inches (12.7 cm) and about 7 inches (17.8 cm); in a trap designed for higher power center fire handguns it will be adequate for the minimum radius of curvature to be about 14 inches (35.6 cm); and in a trap designed for still higher power center fire rifles it will be adequate for the minimum radius of curvature to be about 20 inches (50.8 cm) if the steel of which the chamber boundary wall members are made is hardened and about 28 inches (71.1 cm) if the steel is not hardened. It will be understood, in this regard, that steel hardness and radius of curvature are complementary to each other—the harder the steel, the smaller may be the radius, and vice versa. On the other hand, the angular extent of the arcuate section of the member 23, measured from the edge 23*b* to the beginning of the straight section 23*a*, will ordinarily be somewhat smaller than that of the member 24 measured from the edge 24*b* to the beginning of the straight section 24*a*. Within these parameters, the angular extent of the curved section of the member 23 may be as small as about 120° and up to as large as about 150°, while the angular extent of the curved section of the member 24 may be as small as about 160° and up to as large as about 175°.

The spray nozzle means 16 (FIGS. 2 and 4), by means of which sprays or streams 25 of white water lubricant can be directed into the interior of the deceleration chamber 15, comprises a conduit or pipe 26 securely mounted on the rearwardmost end region of the upper wall 13*a* of the passageway structure 13 where that portion of the wall underlies the frontwardmost end region of the straight planar section 24*a* of the chamber wall member 24. The conduit 26 is positioned between the side walls 11 and 12 and extends across substantially the entire length of the chamber in a direction parallel to the horizontal axis of the same. The conduit 26 is provided with a series of orifices or nozzles 26*a* spaced from one another longitudinally of the conduit, with the orifices facing toward and opening directly into the slit-shaped aperture 15*b*. It will be apparent, therefore, that most of the liquid lubricant exiting from the spray pipe 26 will preferentially enter the chamber 15 and contact the frontwardly facing concave surface of the wall member 24 and will consequently flow downwardly over that surface toward the discharge opening 15*a*. However, some of the liquid sprayed out of the pipe 26 will also drop down onto the lower wall or ramp 13*b* of the passageway structure and will consequently tend to flow downwardly over that ramp surface toward the front of the trap.

The liquid lubricant is initially contained in the collecting vessel 17 and is fed from the same to the spray conduit 26, preferably to one end of the latter, by means of the pump 18*b* and the piping 18*a*, the pump here being shown as a submersible pump mounted on a suitable framework 18c (FIG. 4) within the vessel 17 and serving to draw the liquid from an upper region of the body of liquid in the vessel 17. The collecting vessel, in the embodiment of the invention illustrated in FIGS. 2–4, is located below the rear end region of the trap directly under the outlet opening 27*a* of a funnel or chute 27 which communicates with the interior of the chamber through the bottom discharge opening 15*a* (FIG. 2). Preferably, a removable sieve or strainer member 28 is located in the upper region of the collecting vessel, somewhat below its top rim, the openings of the strainer member being large enough to permit passage of liquid and of lead dust therethrough but small enough to cause bullets, bullet fragments, shells and casings to be retained thereon.

As previously mentioned, some of the liquid lubricant sprayed into the trap 10 by the spray nozzle means 16 falls down onto the lower ramp 13*b* of the passageway structure 13 and then flows along the ramp surface toward the front of the trap. In order to ensure that all of this liquid will be captured and not lost (and will not create a flood on the floor or support surface S), an upwardly open trough-shaped sump or catch basin 29 is provided just below the front edge of the ramp 13*b*. The sump extends along the full width of the ramp and has its bottom plate 29*a* pitched or slanted somewhat from both ends toward the middle (FIG. 3). A drain pipe 30 is connected to the sump 29, with the intake end 30*a* of the pipe being in communication with the lower central region of the sump, and with the discharge end 30*b* of the pipe being located just above the open top of the collecting vessel 17, and serves to return any accumulated liquid from the sump to the vessel.

The target positioning means 14 in this embodiment of the invention may be of any suitable type, serving either for suspending the targets in front of the entrance opening of the trap from an overhead support surface, e.g., the ceiling of the room in which the firing range is located, or for mounting the targets in front of the trap on an underfoot foot support surface, e.g., the floor of the room in which the range is located. Merely by way of example, the means for positioning the targets 31 and 32 shown in FIGS. 2 and 3 include a pair of brackets 33 and 34 in which are journaled a pair of grooved sheaves or pulleys 35 and 36 about which are trained respective cables 35*a* and 36*a* which support the targets through the intermediary of hangers 35*b* and 36*b* and can be operated by the shooters to move the targets into their desired positions.

Although the brackets 33 and 34 could, as previously indicated, be secured directly to the ceiling of the range room, in the illustrated arrangement they are shown as being secured to a steel plate 37 constituting a dry upper baffle which is provided at the front of the trap in conjunction with a similar steel plate 38 constituting a dry lower baffle, the baffles being there primarily for preventing misdirected bullets from passing over or under the trap and for directing such bullets into the passageway structure 13. For this purpose, the two baffles are inclined relative to the horizontal at angles preferably the same as the respective angles of inclination of the ramps 13*a* and 13*b*, but they are mounted in place in different ways. On the one hand, the upper baffle 37 is secured in any suitable way (not shown but preferably by welding or alternatively by means of nuts and bolts) at one end to the undersurface of the upper ramp 13*a* and to corresponding regions of the side walls 11 and 12 and at its other end to the ceiling or to an adjunct of the ceiling (e.g., a ceiling baffle, not shown). On the other hand, the lower baffle 38 is arranged somewhat further above the floor or support surface S than is the lower passageway ramp 13*b* and also terminates short of the proximate front edge of the ramp 13*b*, thereby leaving between them a gap 39 providing access to the sump for the liquid flowing down the ramp. At the same time, the difference in elevation between the plates 38 and 13*b* prevents liquid from jumping onto the baffle and prevents errant bullets from being trapped by the sump. To achieve the proper elevation of the baffle 38, the same is supported at one end by and secured to the front lip of the sump 29, and at a location spaced therefrom the baffle is supported by and secured to a vertical support means 40, which may take the form of a pair of legs or a plate or a framework of some sort (U-shaped, X-shaped or the like).

In operation, therefore, as described in the aforesaid three prior patents, when a projectile B is fired into the trap 10 and impacts against one of the passageway boundary plates, for example, against the lower ramp 13*b* of the passageway structure 13, it will lose a small part of its energy by virtue of that first contact. Thereafter, the projectile continues substantially unimpeded into the deceleration chamber, running along a slightly deflected flight path almost parallel to the ramp surface and passing cleanly through the throat 13*d*. It should again be noted, however, that although in the trap 10, by virtue of its being equipped with a liquid lubricant spray and circulating system, the presence of the lubricant in the passageway and the deceleration chamber does serve to reduce to a great degree the frictional metal to metal contact between the projectile and the plates it contacts, it does not eliminate frictional effects altogether. Accordingly, where the projectile is a bullet made of lead (as probably 90% of all bullets are), there will be a certain amount of lead dust generated which, were it to escape into the atmosphere, would pose a major health and environmental hazard. However, because that lead dust is simultaneously with its formation engulfed in the flowing liquid lubricant and flushed thereby into the collecting vessel 17 either through the discharge opening of the deceleration chamber or through the sump and drain pipe combination, the lead dust cannot escape. Moreover, as the lubricant flows into the vessel 17, the lead dust, being considerably heavier than the liquid, almost immediately settles to the bottom of the vessel and accumulates there.

This action, as can be seen, has two direct and highly advantageous consequences apart from the ecological benefit mentioned above. One is of operational significance, in that the quantity of liquid located in the vessel 17 above the accumulated lead dust therein is effectively self-cleaned. As a result, whenever any part of the liquid in the collecting vessel is extracted by the pump **18*b* from the upper region of the body of liquid in the vessel and recirculated through the piping 18*a* to the spray nozzle means 16, it does not contain any lead dust and clogging of the pump and the nozzles 26*a* is avoided. The other advantageous consequence is of economic significance, in that the system provides an automatic conservation and salvaging of the lead dust as a raw material. Thus, when enough lead dust has accumulated in the collecting vessel to make it appropriate to remove it, the pump is deactivated and extracted from the vessel along with the strainer member 28, the piping 18*a* and the pump-supporting framework 18*c***, after which the vessel is covered and sealed and transported to a suitable location where, under appropriate environmental safeguards, the lead dust can be separated from the liquid remaining in the vessel and processed for reuse in manufacturing bullets.

It should be noted, in this connection, that bullets and bullet fragments caught on the strainer member 28 can also easily be handled for recycling without any danger of airborne lead dust pollution. This is because after having passed through the deceleration chamber, each bullet or fragment, as previously mentioned, has on it and carries along with it a trace coating of the liquid lubricant. It is that coating which holds minute particles of lead to the body of a larger bullet or bullet fragment and prevents such small particles from being disturbed upon collection of the bullets or bullet fragments and thus from becoming airborne.

Reverting now to the bullet entering the trap, the residual energy of the same, after it has passed through the throat or exit opening **13*d* of the passageway structure, is dissipated as the bullet circumnavigates the deceleration chamber 15. During this phase of its movement, the bullet alternatingly jumps from the bottom region of the chamber wall 24 onto the proximate bottom region of the other chamber wall member 23 over the bottom discharge opening of the chamber, and from the top region of the wall member 23 onto the top region of the wall member 24 over the top inlet opening of the chamber, the bullet during this period of its movement remaining in contact with the curved sections of the circumferential boundary wall of the chamber due to the effects of centrifugal force. The spent bullet ultimately either falls off the wall member 24 over the bottom end edge 24*b* thereof or falls off the wall member 23 by sliding back down the straight planar bottom section 23*a* thereof, and thereby passes through the discharge opening 15*a* of the deceleration chamber into the chute 27, from which it drops down onto the strainer member 28. It will be understood, of course, that this discharge occurs to a certain extent by dint of the force of gravity but, in view of the fact that the liquid lubricant is being continuously sprayed against the inner surface of the chamber wall member 24, is assisted by the flushing action of the liquid as it flows downwardly along the chamber wall and thence through the discharge opening of the chamber. It will also be understood that once a bullet has entered the deceleration chamber 15, the arrangement and configurations of the chamber wall members 23 and 24 will prevent the bullet from returning to the lower passageway ramp 13*b***. This provides an advantage, in that there is no possibility of an incoming bullet encountering and hitting an exiting bullet which was previously flattened on and is then lying stationary on the lower ramp of the passageway.

The white water lubricant, apart from its lubricating and flushing functions, also affords yet another advantage, in that it adds a measure of sound-proofing to the trap. In fact, it has been found that the noise level of bullets traveling through the trap is as much as 10 db less in the presence of the liquid than in its absence, because the white water absorbs vibrations and harmonics resulting from the impacts of the bullets against and their movements along the ramps **13*a* and 13*b* of the passageway structure 13 and the circumferential boundary wall members 23 and 24 of the deceleration chamber 15**.

Figure 5:
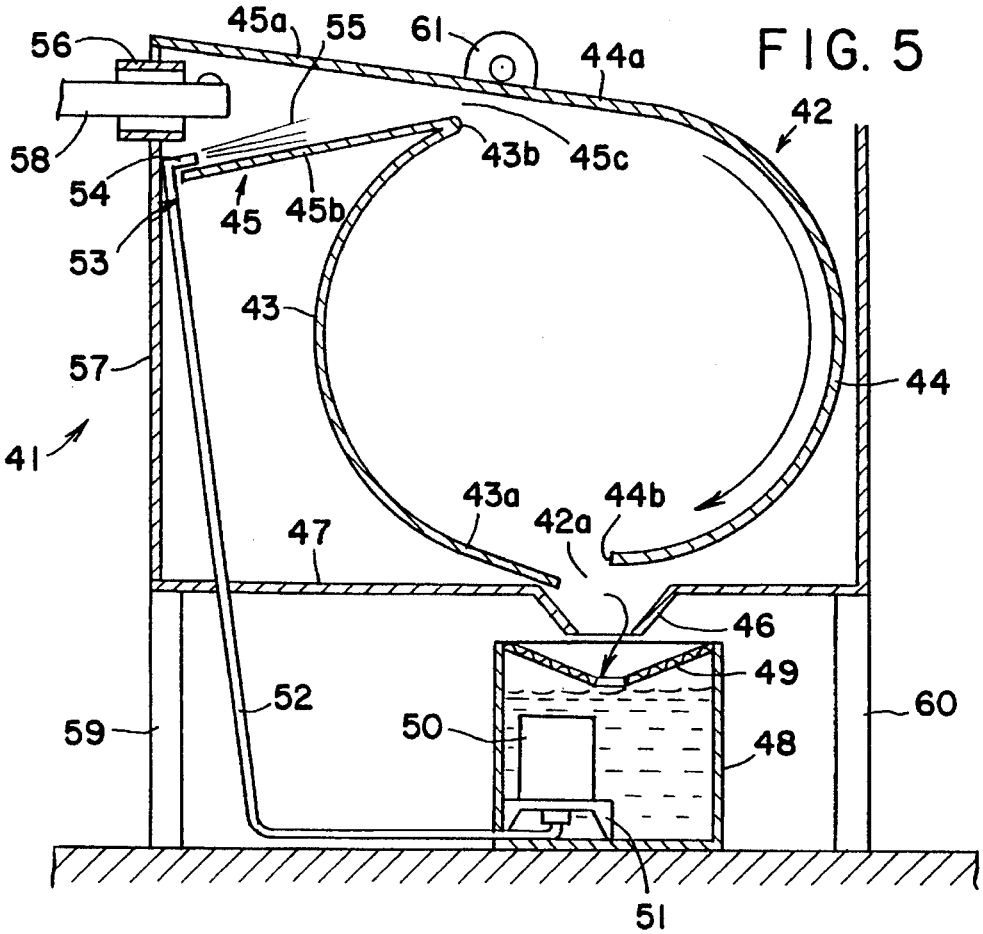
FIG. 5 is a longitudinal vertical section through a modified form of pumped "wet" bullet trap according to the present invention and designed for use by a gunsmith.

Referring now to FIG. 5, the pumped "wet" bullet trap 41 there shown, which is designed for use by a gunsmith and is primarily intended for testing firearms (handguns, shotguns and rifles) and not for recreational or competitive shooting, is considerably smaller than the trap 10 shown in FIGS. 2–4. For example, whereas in a representative indoor firing range bullet trap 10 the length, width and height thereof preferably are on the order of about 216 inches (548.6 cm), 96 inches (243.8 cm) and 96 inches (243.8 cm), respectively, in the case of a typical gunsmith bullet trap 41 those dimensions preferably are on the order of about 44 inches (111.8 cm), 18 inches (45.7 cm) and 52 inches (132.1 cm), respectively. Other than that, however, the basic structures of the two traps are quite similar.

Thus, the trap 41 includes a deceleration chamber 42 constituted of two juxtaposed, oppositely concave, channel-shaped or shell-like wall members 43 and 44, of which the wall member 43 has its concavity directed away from the front of the trap and is curved over most of its extent but has at its lowermost end region a downwardly inclined straight planar section **43*a*, and the wall member 44 has its concavity directed toward the front of the trap and is curved over most of its extent down to an end edge 44*b* but has at its uppermost end region an upwardly inclined straight planar section 44*a*, with the angles of inclination and the widths of the two straight planar sections 43*a* and 44*a* being within the same ranges as the angles of inclination and the widths of the straight planar sections 23*a* and 24*a* of the bullet trap 10. Also, in the bullet trap 41 the passageway structure 45, as in the first described embodiment, includes an upper ramp 45*a* and a lower ramp 45*b* oppositely inclined to the horizontal, with the lower ramp 45*b*, like the ramp 13*b*, being affixed to the uppermost end edge 43*b* of the chamber boundary wall member 43. Here, however, the ramp 45*a* is simply an integral extension of the straight planar section 44*a* of the chamber wall member 44. The bottom discharge opening 42*a* of the deceleration chamber is, as before, defined between the downwardly inclined straight planar section 43*a* of the wall member 43 and the lowermost edge 44*b* of the wall member 44 and is aligned with a funnel-shaped opening or chute 46 provided in the bottom wall 47 of the trap housing through which spent bullets and liquid lubricant can pass to fall into a collecting vessel 48 having a strainer member or sieve 49** located across its top region.

Located within the collecting vessel 48, as before, is a submersible pump 50 mounted on a supporting framework 51 and connected to a pipe 52. The liquid lubricant spraying means 53, however, is somewhat different in that it includes a flattened nozzle 54 to which liquid is fed by the pump 50 through the pipe 52, the nozzle being positioned at the entrance end of the passageway structure 45 in overlying relation to the front end region of the lower ramp 45*b*. The spray 55 exiting from the nozzle 54 is an expanding spray which, as it approaches the throat 45*c*, spreads out enough to cover substantially the entire width of the lower passageway ramp. This is possible because the ramp 45*b* in the trap 41 is only about 8.5 inches (21.6 cm) wide, whereas in the case of the indoor firing range trap 10 a far larger nozzle arrangement is required because the ramp 13*b* is about 96 inches (243.8 cm) wide. Here it should be noted that although a sump and drain pipe combination such as that shown in FIG. 2 for the trap 10 could also be provided for the trap 41, it is not essential in the illustrated embodiment of the latter becuse any part of the sprayed liquid lubricating fluid which will run down the ramp 45*b* will simply drop off the same and down onto the bottom wall 47 of the trap housing and, by virtue of an appropriate degree of slanting (not shown) of that wall, will be returned to the collecting vessel 48 via the chute 46.

The trap 41 has two additional features not found in the trap 10. One is the provision of a firing port 56 in the form of a tube about 4 inches (10.2 cm) in diameter which is mounted in and extends through the upper region of the front wall 57 of the trap housing in direct proximity to and alignment with the passageway structure 45. The port is a safety feature because it effectively compels the gunsmith to insert the muzzle end 58 of the barrel of the gun being tested through the port before the gun is fired. The other feature is that, since the trap 41 is relatively small and intended to be portable, with the maximum width dimension of the trap, about 18 inches (45.7 cm), being the side to side dimension of each of two U-shaped base members 59 and 60 provided at the front and rear ends of the trap, the housing is provided at the top with a pair of ears 61 to facilitate lifting and transporting of the trap.

Figure 6:
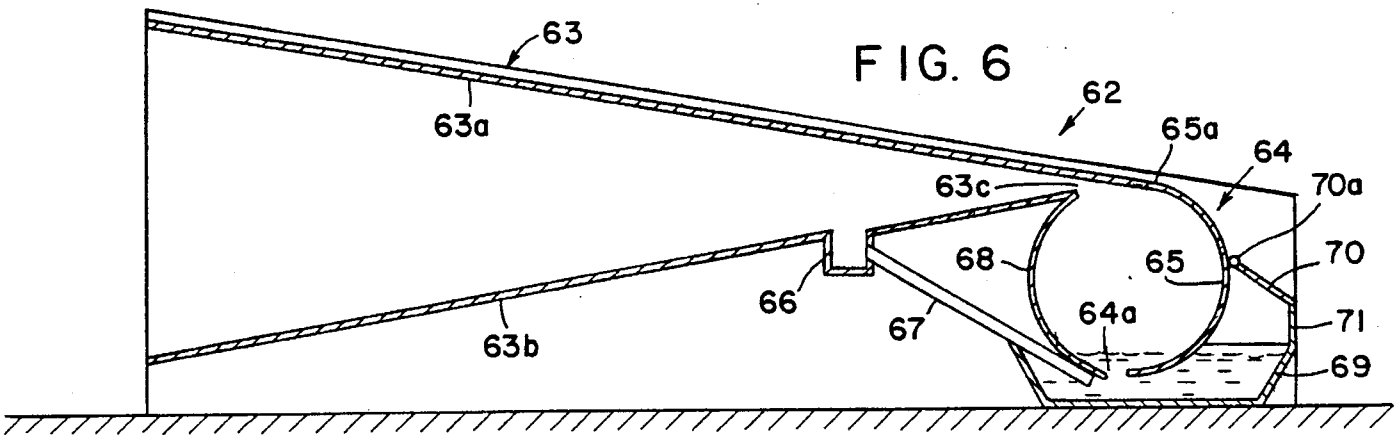
FIG. 6 is a longitudinal vertical section through a pumpless type of "wet" bullet trap according to another embodiment of the present invention and designed for use in an outdoor firing range.

Referring now to FIG. 6, the pumpless "wet" trap 62 there shown, which is designed for use in an outdoor firing range, is basically similar in construction, in respect to the passageway structure 63 and the deceleration chamber 64, to the trap 10. Thus the width and height of the outdoor firing range bullet trap 62 typically are about the same as the width and height of the indoor firing range bullet trap 10, although the outdoor trap (the length of which may be of the same order of magnitude as the length of the indoor trap) typically is somewhat longer than the indoor trap, for example, about 252 inches (640.1 cm). Other than that, the principal differences here are the provision of an upper ramp 63*a* which is a continuation of the straight planar section 65*a* of the frontwardly concave boundary wall member 65 of the deceleration chamber 64, the provision of a sump 66 and a drain pipe 67 near the rear end of the lower ramp 63*b*, and the provision of a passive system for applying the liquid lubricant to the interior surfaces of the chamber 64 which does not utilize a pump and forced flow circulation to a spray nozzle arrangement in the chamber. Rather, in the trap 62 the lowermost region of the deceleration chamber, encompassing the bottom discharge opening 64*a* between the lowermost ends of the chamber wall members 65 and 68, is submerged in a static body of the liquid lubricant contained in a collecting vessel 69. Access to the interior of the vessel, for replenishing the supply of liquid therein and for removing accumulated solids (both lead dust and larger particles) therefrom, is available through a swinging trap door 70 which is hinged at 70*a* to the exterior of the chamber wall member 65 and the free edge of which is adapted to rest on an upstanding ledge or flange 71 of the vessel 69.

In operation of the trap 62, when a bullet fired into the trap enters the chamber 64 through the throat 63*c* and circumnavigates the chamber at high speed, the bullet repeatedly and at a high frequency enters and passes through the portion of the body of liquid lubricant located within the confines of the bottom region of the chamber. This causes a violent splashing of the liquid onto the unsubmerged upper sections of the interior surfaces of the chamber, while at the same time some of the lubricant is picked up and carried along by the bullet. As a result, the bullet is able to move along the chamber wall surfaces with a minimum of frictional drag. It should be noted, in this regard, that at least during the initial period of the high speed movement of the bullet within and around the deceleration chamber 64, the entry of the bullet into the liquid and the consequent splashing of the liquid will be sufficiently violent to cause some of the liquid to jump through the throat 63*c* and onto the lower ramp 63*b*. It is to prevent the loss of such liquid and to arrest its flow toward the front end of the lower ramp that the sump 66 to catch the liquid and the drain pipe 67 to return it to the collecting vessel 69 are provided. The region of the lower ramp 63*b* located frontwardly of the sump 66 is, it will also be noted, somewhat more elevated relative to the base of the trap than the portion of that ramp located rearwardly of the sump, so that if a bullet happens to hit and move along the front portion of the ramp it will jump over and not come into contact with the rear edge of the sump, thereby avoiding being trapped in the sump.

With respect to outdoor firing ranges, it might be noted that it has already been pointed out above that one of the principal reasons for the use of a bullet-activated passive lubricant-applying system in such a range in lieu of an active pump-driven circulating system is the fact that electrical service for operating the required pump is not always available at the range site or is too expensive to install. Nevertheless, there is also another factor which, in the case of an outdoor firing range, makes the passive system an acceptable alternative to the active system.

As is well known, most ammunition shot outdoors utilizes jacketed bullets, i.e., lead bullets each encased in a copper jacket. When such a bullet is fired into a bullet trap according to the present invention, the jacket is not stripped from the bullet when the latter contacts, is deflected by and moves along the passageway ramp, so that during that time the presence of the jacket ensures there is no lead dust generated or released into the environment. It is only when the bullet has entered and undergoes compression in the deceleration chamber that the jacket is stripped off and lead dust begins to be generated. However, the bullet, upon entering the deceleration chamber at the top, almost instantaneously thereafter reaches the bottom of the chamber and enters the body of liquid lubricant there located, which then happens again and again many times during the following few seconds as the bullet's energy is dissipated. As a result, any lead dust that is generated during this time interval remains confined in the deceleration chamber and almost immediately becomes submerged in the body of liquid lubricant covering the bottom discharge opening of the chamber. Thus, even without the flushing function of the positive circulating system, no release of lead dust into the environment is possible or permitted to take place either from the passageway or from the deceleration chamber.

As a possible refinement of the solids collection system, in order to enable larger particles such as bullets and bullet fragments to be accumulated separately from minute particles such as lead dust, an elevated strainer member (not shown) standing on legs in the collecting vessel 69 may be provided, with the openings in the strainer member as before being of a size sufficient to permit lead dust to pass therethrough but not the larger bullets and bullet fragments. Alternatively, a conveyor belt-type retrieval device (not shown) could be added to the trap, with the belt being made of a strainer sheet material capable of passing lead dust but not larger particles. In such a system, one end region of the belt would be positioned directly below the discharge opening 64*a* of the deceleration chamber, and the other end of the belt would be positioned above a suitable receptacle outside the trap to permit the large particles previously caught by the first end region of the belt to drop off the belt at the second end region of the latter and fall into the receptacle. If need be, the belt could be arranged to run out of the confines of the vessel 69 at an upward slant sufficient to clear the ledge or flange 71 of the vessel.

It will also be understood that by virtue of the use of the passive lubricating system in the trap 62, the same can be manufactured and sold relatively inexpensively, since no installation or maintenance of a pump and its associated piping and power supply is required. The quantity of liquid lubricant likewise requires substantially no maintenance, except possibly for an occasional replenishment of the liquid to take into account any loss of water by evaporation. A float-operated mechanical indicator (not shown) may be used to bring to the range director's attention a dropping of the level of the liquid to the point of requiring replenishment. Under excessive cold weather conditions, the liquid if frozen can be easily replaced, or it can be supplemented by any suitable anti-freeze composition to prevent congealing or freezing.

Figure 7:
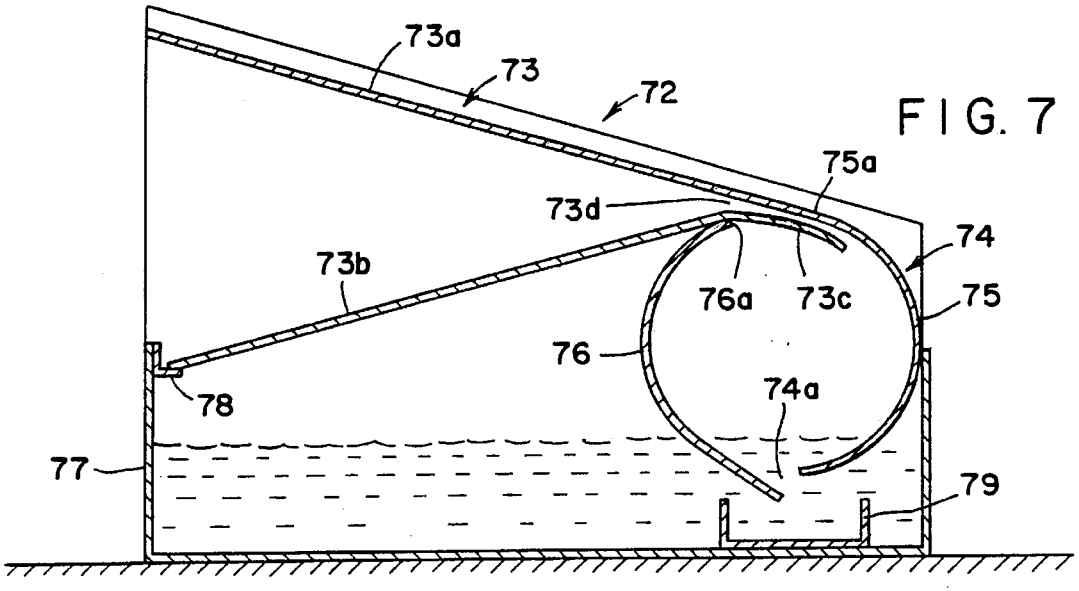
FIG. 7 is a longitudinal vertical section through a modified form of pumpless "wet" bullet trap designed for use in a pistol and rim firing environment.

The bullet trap 72 shown in FIG. 7 is, like the trap 62, a pumpless "wet" trap which is designed for use in pistol and rim firing, i.e., the firing of low energy bullets (.22 caliber up to .22 Magnum). The trap 72 has a passageway structure 73 and a deceleration chamber 74, the former including an upper ramp 73*a* which is an integral extension of the straight planar section 75*a* of the frontwardly concave boundary wall member 75 of the deceleration chamber. The lower ramp 73*b* of the passageway structure 73 is, however, not welded at its rear edge to the upper edge 76*a* of the rearwardly concave chamber boundary wall member 76. Rather, the lower ramp 73*b* has an angled extension portion 73*c* which is integral, i.e., of one piece, with the body of the ramp 73*b*, and the entire unit is either loosely supported by or hinged to the edge 76*a* of the member 76 at the region of the juncture between the main portion of the ramp and the extension portion 73*c* thereof. The front end edge of the lower ramp normally rests loosely on the top of the front end wall of the base 77 of the trap, either directly or (as shown by way of example only) on a transverse flange or bracket 78 affixed to that wall, while the angle of inclination of the extension portion 73*c* is such that, when the lower ramp is in its rest position, the extension portion is oriented substantially parallel to the upper straight planar section 75*a* of the chamber wall member 75. It will be understood, therefore, that by virtue of this arrangement the ramp 73*b* can be raised from its rest location by being swung upwardly about the pivot axis established at the upper edge of the chamber wall member 76, to provide access to the interior of the base 77 which also constitutes the container for the static body of the liquid lubricant in which the bottom end region of the deceleration chamber is submerged. A suitable basket or tray 79 is positioned in the liquid container 77 directly under the bottom discharge opening 74*a* of the deceleration chamber 74 to catch spent bullets, fragments thereof, and lead dust (if any) falling out of the chamber, the base 77 and the tray 79 thus comprising the collecting vessel of the trap 72.

In operation of the trap 72, which typically is between about 48 and 60 inches (121.9 and 152.4 cm) in length, between about 18 and 24 inches (45.7 and 60.7 cm) in width, and between about 60 and 65 inches (152.4 and 165.1 cm) in height, when a bullet fired into the trap enters the chamber 74 through the elongated throat 73*d* defined between the ramp extension portion 73*c* and the adjacent straight planar section 75*a* of the chamber wall 75 and circumnavigates the chamber at high speed, the bullet (as in the case of the trap 62) repeatedly and at a high frequency enters and passes through the portion of the static body of the liquid lubricant located within the confines of the bottom region of the chamber. This causes a violent splashing of the liquid onto the unsubmerged upper sections of the interior surfaces of the chamber, including the undersurface of the ramp portion 73*c*, while at the same time some of the lubricant is picked up and carried along by the bullet. As a consequence thereof, the bullet is able to move along the chamber walls with a minimum of frictional drag. It should be noted, however, that regardless of how violent the splashing may be, the presence of the extended ramp portion 73*c* will inhibit any jumping of the liquid through the throat 73*d* and onto the lower ramp 73*b*. It is for this reason that the possibility of loss of such liquid, which necessitates the provision of the sump and drain pipe combination in the trap 62, can be disregarded in the trap 72.

Figure 8:
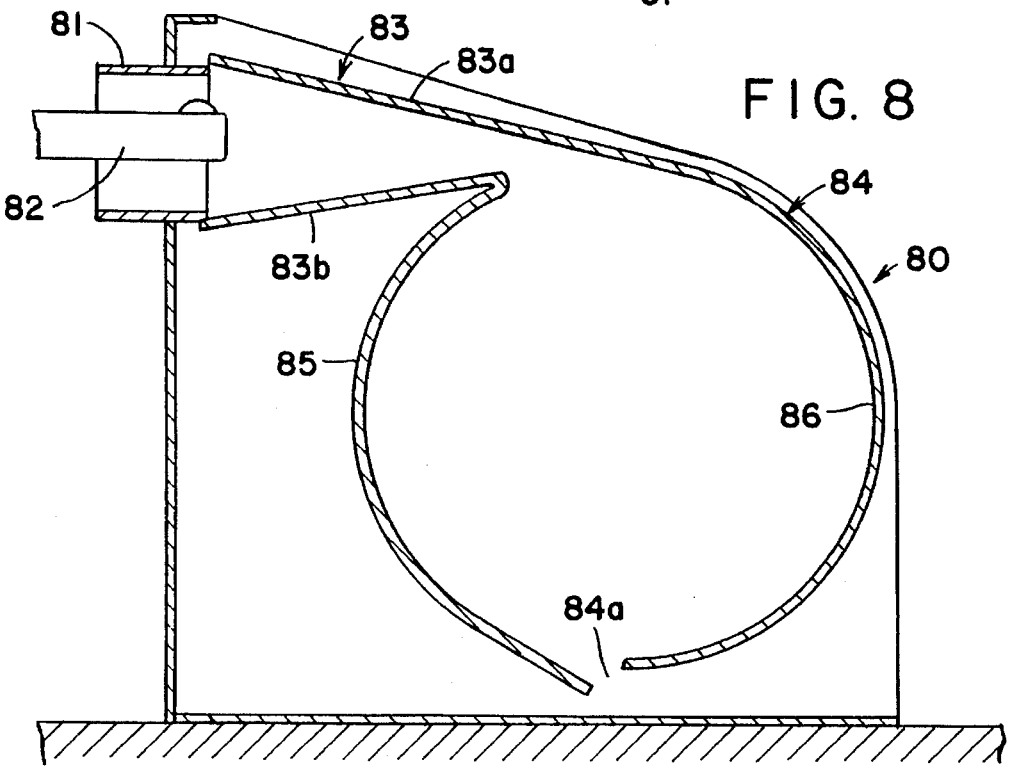
FIG. 8 is a longitudinal vertical section through a "dry" type of bullet trap similar to the "wet" trap shown in FIG. 5 but designed for use as a device for checking a firearm after a shooting session for the presence of a bullet in the firing chamber.

Turning now to FIG. 8, it will be readily apparent that the "dry" trap 80 there shown, which (as previously mentioned herein) is designed for enabling a person at the end of a shooting session to check the condition of a firearm with a single shot for determining whether, and making certain that, the firing chamber of the firearm is empty, is, except for the absence of a liquid circulation system, essentially identical to the trap 41 shown in FIG. 5. Thus, the trap has a passageway structure 83 with low angle inclined upper and lower ramps 83*a* and 83*b* leading into a deceleration chamber 84, and the chamber has two juxtaposed, oppositely concave, spirally curved front and rear wall members 85 and 86 defining a bottom discharge opening 84*a* for the chamber, with the bottom of the trap housing defining a collecting vessel. The presence of the firing port 81, which as before is a tube about 4 inches (10.2 cm) in diameter and is intended to receive the muzzle end 82 of the barrel of the gun being checked, is again provided for safety reasons. The entire arrangement, of course, ensures that a bullet fired into the trap 80 can neither return to injure the shooter nor destroy the trap. In terms of size, the trap 80 typically is about the same as the trap 41, i.e. 44 inches (111.8 cm) long, 18 inches (45.7 cm) wide and 52 inches (132.1 cm) high, but it can be somewhat smaller, for example, if it is intended to be used only with relatively low energy projectiles, down to being about 22 inches (55.9 cm) long, 5 inches (12.7 cm) wide and 20 inches (50.8 cm) high.

It will be understood that the foregoing description of preferred embodiments of the present invention is for purposes of illustration only, and that the various structural and operational features herein disclosed are susceptible to a number of modifications and changes none of which entails any departure from the spirit and scope of the present invention as defined in the hereto appended claims.

I claim:

1. A bullet trap for catching and deenergizing bullets fired along a substantially horizontal path of flight into the trap from manual firearms, which trap includes: a first pair of spaced flat plates located, respectively, above and below said path of flight and oriented at respective opposite angles of inclination of between 0° and about 15° to the horizontal, and a second pair of spaced flat plates arranged transverse to said first plates on opposite sides of said path of flight, with said first and second pairs of plates defining, respectively, upper and lower walls and right and left side walls of a passageway having at its front end an entrance opening and at its rear end a throat through which the bullets can pass, and with said upper and lower walls of said passageway converging toward one another in the direction from said entrance opening of said passageway to said throat; a spent bullet decelerating and energy-dissipating chamber which has a substantially horizontal axis and a circumferential boundary wall of generally spiral configuration, with the opposite end walls of said chamber being constituted by portions of said second plates, and with said passageway communicating with said chamber substantially tangentially of said chamber through said throat; means for directing a liquid lubricating fluid into said chamber for enabling said lubricating fluid to be applied to at least a portion of said circumferential boundary wall of said chamber; and means defining a collecting vessel located at a discharge region of the trap for receiving therefrom spent bullets, bullet fragments, shells, casings and lead dust; wherein the improvement comprises:

(a) said upper and lower walls of said passageway at said rear end of said passageway are connected to said decelerating chamber at a top region of said chamber, with said throat of said passageway located at said circumferential boundary wall of said chamber;

(b) said decelerating chamber is provided in said circumferential boundary wall thereof at said top region of said chamber with an inlet opening extending substantially parallel to said horizontal axis of said chamber and in direct communication with said throat of said passageway; and (c) said decelerating chamber is provided in said circumferential boundary wall thereof at a bottom region of said chamber with a discharge opening for enabling liquid lubricating fluid, bullets, bullet fragments, shells, casings and lead dust to pass therethrough for movement to said collecting vessel;

(d) whereby bullets fired into said passageway through said entrance opening of said passageway first enter into said decelerating chamber through said throat and said inlet opening without undergoing a sudden high angle change of direction between said through and said inlet opening and without impacting against any wall surface at a high angle to that surface and then circumnavigate said chamber with gradually decreasing speed, while in contact with said circumferential boundary wall of said chamber and lubricated by said liquid lubricating fluid directed into said chamber, until the energy of the bullets has been substantially dissipated, and the bullets along with any bullet fragments, shells, casings and lead dust ultimately fall through said discharge opening of said chamber and move to said collecting vessel.

2. A bullet trap as claimed in claim 1, wherein: said collecting vessel is located below said discharge opening of said decelerating chamber.

3. A bullet trap as claimed in claim 2, wherein: means defining a chute or funnel are associated with the trap intermediate said discharge opening of said decelerating chamber and said collecting vessel for guiding bullets, bullet fragments, shells, casings and lead dust from said chamber to said collecting vessel.

4. A bullet trap as claimed in claim 1, wherein: said decelerating chamber comprises first and second cross-sectionally arcuate channel-shaped members each having a concave side with a respective horizontal axis of curvature; each of said channel-shaped members has an upper end region and a lower end region and is arranged with said concave side thereof facing toward said concave side of the other member, with said concave side of said first member facing toward said front end of said passageway and said concave side of said second member facing away from said front end of said passageway so that said channel-shaped members jointly constitute said circumferential boundary wall of said decelerating chamber; and said channel-shaped members are arranged to provide a first gap between their respective upper end regions defining said inlet opening of said decelerating chamber and a second gap between their respective lower end regions defining said discharge opening of said decelerating chamber.

5. A bullet trap as claimed in claim 4, wherein: said first channel-shaped member beginning at said lower end region thereof has a curved section which at said upper end region of said first channel-shaped member merges into a first straight planar section extending past said upper end region of said second channel-shaped member at a spacing therefrom and oriented at an angle of inclination to the horizontal which is substantially the same as that of said upper wall of said passageway; and said second channel-shaped member beginning at said upper end region thereof has a curved section which at said lower end region of said second channel-shaped member merges into a second straight planar section extending past said lower end region of said first channel-shaped member at a spacing therefrom and oriented at a downward angle of inclination of between about 15° and about 30° to the horizontal.

6. A bullet trap as claimed in claim 5, wherein: said first straight planar section of said first channel-shaped member has a frontwardmost extremity which overlies and is spaced from a rearwardmost extremity of said upper wall of said passageway; and said means for directing liquid lubricating fluid into said decelerating chamber comprises spray nozzle means arranged to spray said liquid lubricating fluid into and through the space between said extremities of said first straight planar section of said first channel-shaped member and said upper wall of said passageway and thence into said chamber.

7. A bullet trap as claimed in claim 6, wherein: said spray nozzle means comprises a conduit substantially coextensive in length with said space between said extremities of said first straight planar section and said upper passageway wall and provided with a plurality orifices distributed lengthwise of said conduit; said conduit is mounted above said extremity of said upper passageway wall in direct proximity to said space; and said orifices in said conduit are positioned to open directly into said space.

8. A bullet trap as claimed in claim 6 or 7, wherein: said collecting vessel is located below said discharge opening of said decelerating chamber; and conduit means including pump means interconnected between said collecting vessel and said spray nozzle means are provided for extracting liquid lubricating fluid from said collecting vessel and feeding it to said spray nozzle means for spraying into said space and therethrough into said decelerating chamber.

9. A bullet trap as claimed in claim 8, wherein: the trap beneath a region of said lower wall of said passageway proximate to said front end of said passageway is provided with a sump for receiving any portion of the liquid lubricating fluid which, upon being sprayed into said space by said spray nozzle means, does not enter said decelerating chamber but descends to and runs down along said lower wall of said passageway, and intermediate said sump and said collecting vessel is provided with a drain pipe which has one end in communication with a low region of said sump and another end in communication with an upper region of said collecting vessel for enabling said portion of the liquid lubricating fluid to be returned to said collecting vessel.

10. A bullet trap as claimed in claim 5, wherein: said first straight planar section of said first channel-shaped member is continuous with and merges into said upper wall of said passageway; and said means for directing liquid lubricating fluid into said decelerating chamber comprises spray nozzle means arranged to spray liquid lubricating fluid into said passageway through said front end thereof so as to flow upwardly along said lower passageway wall and thence through said throat into said decelerating chamber.

11. A bullet trap as claimed in claim 10, wherein: said spray nozzle means comprises a nozzle overlying a frontwardmost end region of said lower wall of said passageway, said nozzle being flattened to provide an expanding spray which, as it approaches said throat, spreads over substantially the entire width of said lower passageway wall.

12. A bullet trap as claimed in claim 10 or 11, wherein: said collecting vessel is located below said discharge opening of said decelerating chamber; and conduit means including pump means interconnected between said collecting vessel and said spray nozzle means are provided for extracting liquid lubricating fluid from said collecting vessel and feeding it to said spray nozzle means for spraying into said passageway and therethrough via said throat into said decelerating chamber.

13. A bullet trap as claimed in claim 10 or 11, wherein: the trap is provided at said front end of said passageway with a firing port for accommodating the muzzle end of a firearm from which a bullet is to be fired into the trap.

14. A bullet trap as claimed in claim 10 or 11, wherein: the trap includes a housing within which said passageway and said decelerating chamber are located; said housing has a bottom wall which is arranged below said chamber and above said collecting vessel and is provided with a chute between said discharge opening of said chamber and said collecting vessel for guiding liquid lubricating fluid and spent bullets, bullet fragments, shells, casings and lead dust from said chamber to said collecting vessel, said bottom wall of said housing further serving for returning to said chute and therethrough to said collecting vessel any portion of the liquid lubricating fluid which, upon being sprayed into said passageway and up said lower passageway wall by said spray nozzle means, does not enter said decelerating chamber but runs back down said lower passageway wall and drops onto said bottom wall of said housing.

15. A bullet trap as claimed in claim 5, wherein: said first straight planar section of said first channel-shaped member is continuous with and merges into said upper wall of said passageway; and said means for directing liquid lubricating fluid into said decelerating chamber comprises said collecting vessel with a quantity of liquid lubricating fluid contained therein, said collecting vessel being located directly under said decelerating chamber, with said lower end regions of said first and second channel-shaped members and said discharge opening of said chamber defined thereby being disposed within the confines of said collecting vessel, and with the level of the quantity of liquid lubricating fluid contained in said vessel being sufficiently high to cover said lower end regions of said channel-shaped members and therewith said discharge opening of said chamber; whereby a bullet fired into the trap, upon approaching, during the downward portion of each circuit of its movement over said circumferential boundary wall of said decelerating chamber, the portion of the quantity of liquid lubricating fluid which covers said lower end regions of said channel-shaped members, enters said portion of the quantity of liquid lubricating fluid and causes some of the same to be violently splashed onto those regions of said channel-shaped members which are not covered by said portion of the quantity of liquid lubricating fluid.

16. A bullet trap as claimed in claim 15, wherein: the trap beneath a medial region of said lower wall of said passageway is provided with a sump for receiving any liquid lubricating fluid which is splashed by a bullet onto said lower passageway wall and runs down along the latter, and intermediate said sump and said collecting vessel is provided with a drain pipe which has one end in communication with a low region of said sump and another end in communication with an upper region of said collecting vessel for enabling such liquid lubricating fluid to be returned to said collecting vessel.

17. A bullet trap as claimed in claim 15, wherein: said lower wall of said passageway at its rearwardmost end region is provided with an angled extension portion and is pivotally supported by said upper end region of said second channel-shaped member at the juncture between said rearwardmost end region and said extension portion; the trap is provided with a stop or abutment providing support for said lower passageway wall at its frontwardmost end region and defining a rest position for said lower passageway wall; and the angular orientation of said extension portion relative to said lower passageway wall is such that when said lower passageway wall is in said rest position thereof, said extension portion is oriented substantially parallel to said first straight planar section of said first channel-shaped member.

18. A bullet trap for catching and de-energizing bullets fired along a substantially horizontal path of flight into the trap from manual firearms, which trap includes: a first pair of spaced flat plates located, respectively, above and below said path of flight and oriented at respective opposite angles of inclination of between 0° and about 15° to the horizontal, and a second pair of spaced flat plates arranged transverse to said first plates on opposite sides of said path of flight, with said first and second pairs of plates defining, respectively, upper and lower walls and right and left side walls of a passageway having at its front end an entrance opening and at its rear end a throat through which the bullets can pass, and with said upper and lower walls of said passageway converging toward one another in the direction from said entrance opening of said passageway to said throat; a spent bullet decelerating and energy-dissipating chamber which has a substantially horizontal axis and a circumferential boundary wall of generally spiral configuration, with the opposite end walls of said chamber being constituted by portions of said second plates, and with said passageway communicating with said chamber substantially tangentially of said chamber through said throat; and means defining a collecting vessel located at a discharge region of the trap for receiving therefrom spent bullets, bullet fragments, shells, casings and lead dust; wherein the improvement comprises:

(a) said upper and lower walls of said passageway at said rear end of said passageway are connected to said decelerating chamber at a top region of said chamber, with said throat of said passageway located at said circumferential boundary wall of said chamber;

(b) said decelerating chamber is provided in said circumferential boundary wall thereof at said top region of said chamber with an inlet opening extending substantially parallel to said horizontal axis of said chamber and in direct communication with said throat of said passageway; and (c) said decelerating chamber is provided in said circumferential boundary wall thereof at a bottom region of said chamber with a discharge opening for enabling bullets, bullet fragments, shells, casings and lead dust to pass therethrough for movement to said collecting vessel;

(d) whereby bullets fired into said passageway through said entrance opening of said passageway first enter into said decelerating chamber through said throat and said inlet opening without undergoing a sudden high angle change of direction between said throat and said inlet opening and without impacting against any wall surface at a high angle to that surface and then circumnavigate said chamber with gradually decreasing speed, while in contact with said circumferential boundary wall of said chamber, until the energy of the bullets has been substantially dissipated, and the bullets along with any bullet fragments, shells, casings and lead dust ultimately fall through said discharge opening of said chamber and move to said collecting vessel.

19. A bullet trap as claimed in claim 18, wherein: said collecting vessel is located below said discharge opening of said decelerating chamber.

20. A bullet trap as claimed in claim 18, wherein: said decelerating chamber comprises first and second cross-sectionally arcuate channel-shaped members each having a concave side with a respective horizontal axis of curvature; each of said channel-shaped members has an upper end region and a lower end region and is arranged with said concave side thereof facing toward said concave side of the other member, with said concave side of said first member facing toward said front end of said passageway and said concave side of said second member facing away from said front end of said passageway so that said channel-shaped members jointly constitute said circumferential boundary wall of said decelerating chamber; and said channel-shaped members are arranged to provide a first gap between their respective upper end regions defining said inlet opening of said decelerating chamber and a second gap between their respective lower end regions defining said discharge opening of said decelerating chamber.

21. A bullet trap as claimed in claim 20, wherein: said first channel-shaped member beginning at said lower end region thereof has a curved section which at said upper end region of said first channel-shaped member merges into a first straight planar section extending past said upper end region of said second channel-shaped member at a spacing therefrom and oriented at an angle of inclination to the horizontal which is substantially the same as that of said upper wall of said passageway; and said second channel-shaped member beginning at said upper end region thereof has a curved section which at said lower end region of said second channel-shaped member merges into a second straight planar section extending past said lower end region of said first channel-shaped member at a spacing therefrom and oriented at a downward angle of inclination of between about 15° and about 30° to the horizontal.

22. A bullet trap as claimed in claim 21, wherein: said first straight planar section of said first channel-shaped member is continuous with and merges into said upper wall of said passageway.

23. A bullet trap as claimed in claim 21 or 22, wherein: the trap is provided at said front end of said passageway with a firing port for accommodating the muzzle end of a firearm from which a bullet is to be fired into the trap.

* * * * *